US012029934B1

(12) United States Patent
Casillas et al.

(10) Patent No.: US 12,029,934 B1
(45) Date of Patent: Jul. 9, 2024

(54) NORDIC SIDE-KICK EXERCISE APPARATUS

(71) Applicants: Kyle Casillas, Thompson, ND (US); Andrew Straub, Grand Forks, ND (US)

(72) Inventors: Kyle Casillas, Thompson, ND (US); Andrew Straub, Grand Forks, ND (US)

( * ) Notice: Subject to any disclaimer, the term of this patent is extended or adjusted under 35 U.S.C. 154(b) by 0 days.

(21) Appl. No.: 18/542,649

(22) Filed: Dec. 16, 2023

(51) Int. Cl.

| | |
|---|---|
| ***A63B 21/06*** | (2006.01) |
| ***A63B 21/00*** | (2006.01) |
| ***A63B 23/035*** | (2006.01) |
| ***A63B 23/04*** | (2006.01) |

(52) U.S. Cl.
CPC ..... *A63B 21/0618* (2013.01); *A63B 21/4013* (2015.10); *A63B 23/03516* (2013.01); *A63B 23/0494* (2013.01); *A63B 21/0004* (2013.01); *A63B 21/00047* (2013.01); *A63B 21/4043* (2015.10); *A63B 2208/0214* (2013.01)

(58) Field of Classification Search
CPC ..... A63B 21/0618; A63B 21/4013; A63B 21/0004; A63B 21/00047; A63B 21/062; A63B 21/0626; A63B 21/4043; A63B 23/03516; A63B 23/0494
See application file for complete search history.

(56) References Cited

U.S. PATENT DOCUMENTS

| | | | | |
|---|---|---|---|---|
| 5,066,003 | A | 11/1991 | Jones | |
| 5,540,640 | A * | 7/1996 | Povilaitis | A63B 21/072 482/106 |
| 7,150,702 | B2 | 12/2006 | Webb | |
| 10,500,432 | B2 * | 12/2019 | Bentley | A63B 23/047 |
| 11,452,899 | B2 * | 9/2022 | Sorin | A63B 21/4007 |
| 2007/0010384 | A1 * | 1/2007 | Roberts | A63B 21/4015 482/141 |
| 2011/0224051 | A1 * | 9/2011 | Larish | A63B 21/0618 482/93 |
| 2017/0014681 | A1 | 1/2017 | Doherty | |

* cited by examiner

*Primary Examiner* — Megan Anderson
(74) *Attorney, Agent, or Firm* — Fargo Patent & Business Law; Thomas Kading

(57) ABSTRACT

An exercise apparatus includes a base plate; a weight horn that extends from the base plate along a weight horn axis transverse to the base plate; and a restraint assembly that extends from the base plate along a restraint assembly axis transverse to the base plate.

16 Claims, 4 Drawing Sheets

NORDIC SIDE-KICK EXERCISE APPARATUS

CROSS REFERENCE TO RELATED APPLICATION[S]

None

BACKGROUND

The present disclosure relates to exercise equipment and more specifically to an exercise apparatus to perform a Nordic Hamstring Exercise.

In muscular exercise there are three main types of muscle contraction. These contractions are concentric, eccentric, and isometric. Concentric contraction is where the muscle is contracted, i.e., lilting a dumbbell, doing bench presses or arm or leg curls of many varieties. Eccentric contraction is the lengthening or stretching of a muscle and examples of this type of movement are lowering of the dumbbell or the lowering of the leg in a leg curl. The final type of muscular contraction is isometric, in this form of muscle usage there is no actual change in muscle length while the muscle is contracting, examples of when this occurs is when pushing against a wall or in the pause between eccentrics and concentric phases.

A myriad of exercise machines are available. Oftentimes such machines are cumbersome and provide limited versatility.

SUMMARY

An exercise apparatus according to one disclosed non-limiting embodiment of the present disclosure includes a base plate; a weight horn that extends from the base plate along a weight horn axis transverse to the base plate; and a restraint assembly that extends from the base plate along a restraint assembly axis transverse to the base plate.

A further embodiment of any of the foregoing embodiments of the present disclosure includes that one or more edges of the base plate form an upturned lip.

A further embodiment of any of the foregoing embodiments of the present disclosure includes that the weight horn axis is parallel to the restraint assembly axis.

A further embodiment of any of the foregoing embodiments of the present disclosure includes that the restraint assembly comprises a spar to telescopically receive an adjustable spar.

A further embodiment of any of the foregoing embodiments of the present disclosure includes that a cross-member that extends from the adjustable spar.

A further embodiment of any of the foregoing embodiments of the present disclosure includes that cylindrical cushions that sheath the cross-member to provide ankle restraints.

A further embodiment of any of the foregoing embodiments of the present disclosure includes a quick release bolt selectively engageable with one of a multiple of complementary holes in the adjustable spar to permit height adjustability of the ankle restraints.

A further embodiment of any of the foregoing embodiments of the present disclosure includes an attachment point affixed to the spar.

An exercise apparatus according to one disclosed non-limiting embodiment of the present disclosure includes a base plate comprising a lateral edge that forms an upturned lip; a weight horn that extends from the base plate along a weight horn axis perpendicular to the base plate; and a restraint assembly that extends from the base plate along a restraint assembly axis perpendicular to the base plate, the weight horn axis parallel to the restraint assembly axis.

A further embodiment of any of the foregoing embodiments of the present disclosure includes an attachment point affixed to the restraint assembly.

A further embodiment of any of the foregoing embodiments of the present disclosure includes, a spar; an adjustable spar telescopically movable with respect to the spar; a cross-member that extends from the adjustable spar; and a cylindrical cushion that sheaths the cross-member to provide ankle restraints.

A further embodiment of any of the foregoing embodiments of the present disclosure includes a quick release bolt selectively engageable with one of a multiple of complementary holes in the adjustable spar to permit height adjustability of the ankle restraints.

A further embodiment of any of the foregoing embodiments of the present disclosure includes that the spar and the adjustable spar are square in cross-section.

A further embodiment of any of the foregoing embodiments of the present disclosure includes that the weight horn is circular in cross-section.

The foregoing features and elements may be combined in various combinations without exclusivity, unless expressly indicated otherwise. These features and elements, as well as the operation thereof, will become more apparent in light of the following description and the accompanying drawings. It should be appreciated, however, that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
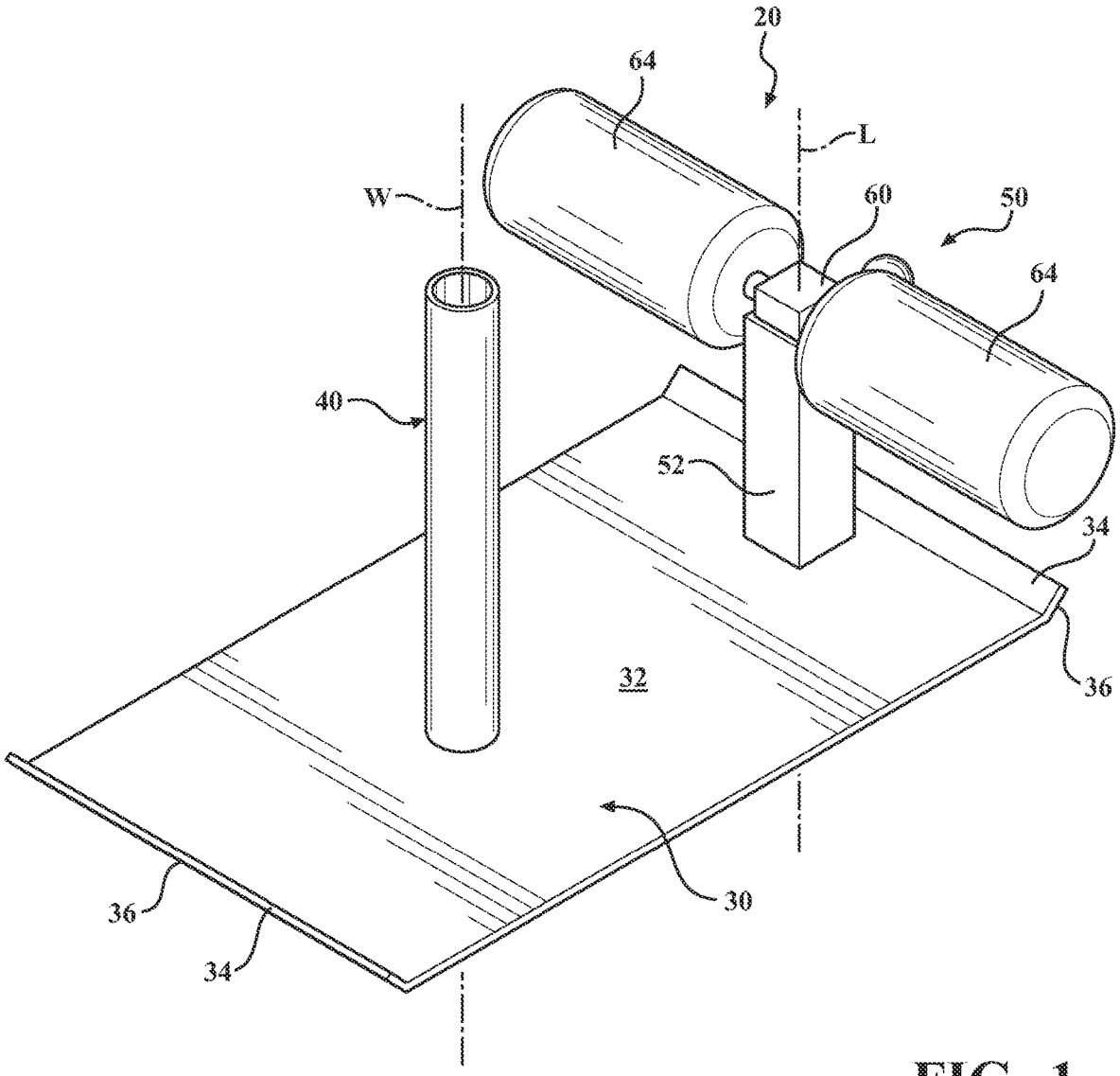
FIG. 1 is a perspective view of an exercise apparatus according to one disclosed non-limiting embodiment.
Figure 2:
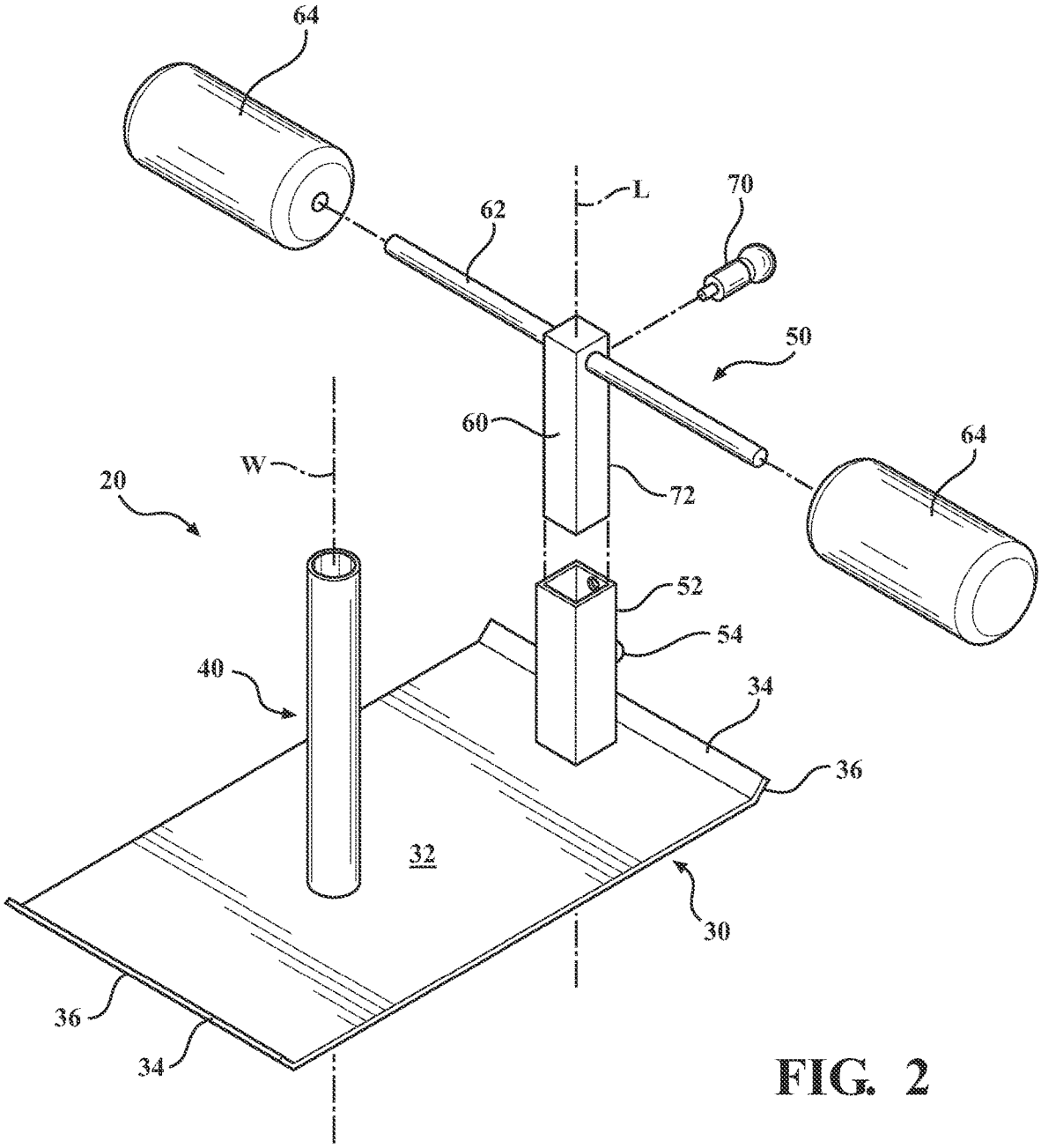
FIG. 2 is an exploded view of the exercise apparatus.

FIGS. 1 and 2 schematically illustrate an exercise apparatus 20 that facilitates multiple exercises such as the Nordic Hamstring Exercise (FIG. 3) yet is readily transportable. The exercise apparatus 20 generally includes a base plate 30, a weight horn 40, and a restraint assembly 50. The exercise apparatus 20 may be manufactured from suitably durable materials such as steel or aluminum which may be preferred, other materials such as non-metallic materials may also be envisaged.

Figure 4:
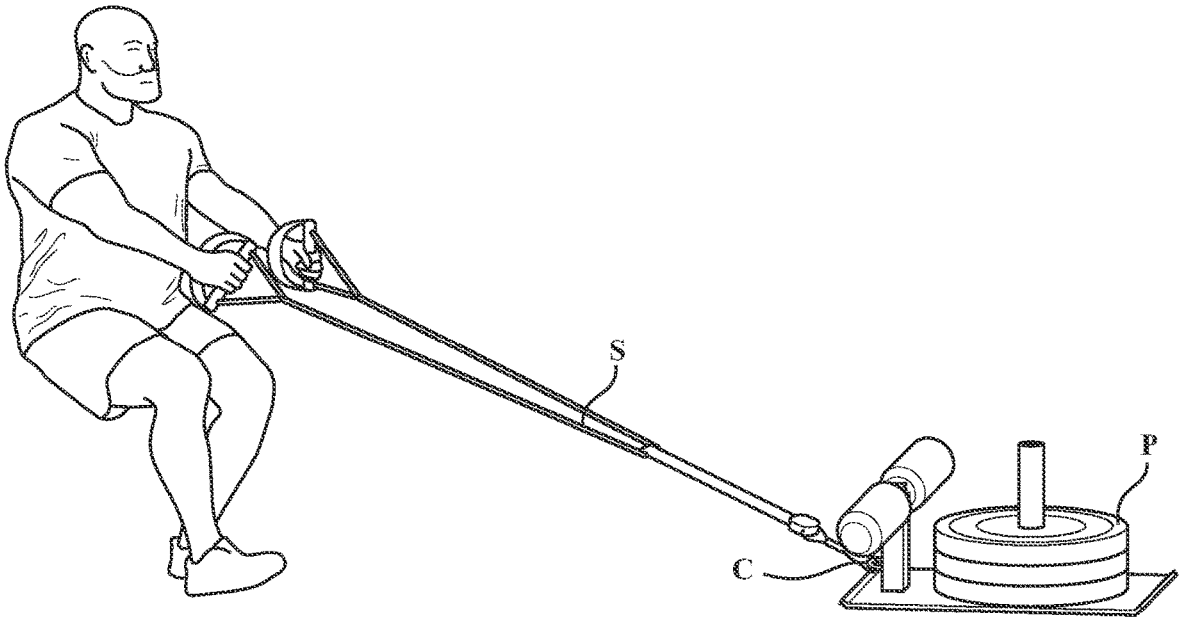
FIG. 4 is a schematic view of the exercise apparatus utilized in an exercise.

The base plate 30 includes a generally flat planar plate 32 to which the weight horn 40 and the restraint assembly 50 are mounted such as via welding. One or more edge 34 of the generally flat planar plate 32 may be formed as a slightly upturned lip 36 such as, e.g., at 45 degrees to form a no-snag edge such that the exercise apparatus 20 may operate as a weight sled (FIG. 4). In one embodiment, the slightly upturned lip 36 is formed along the lateral edges of the base plate 30.

Figure 3:
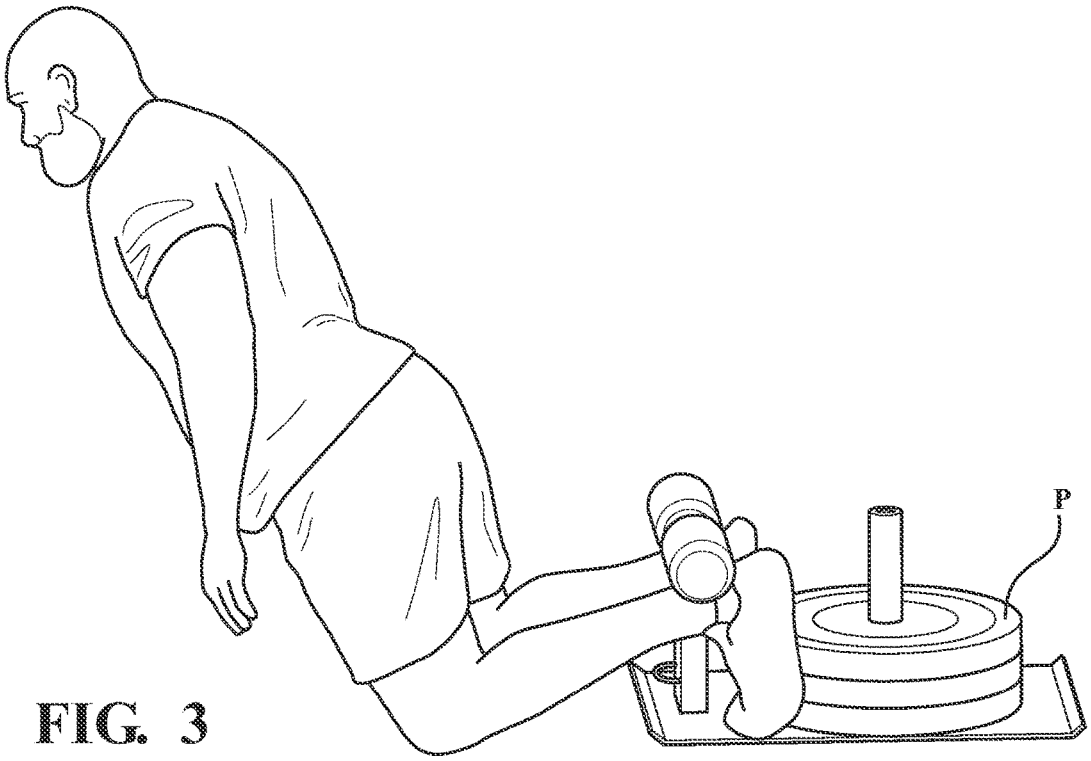
FIG. 3 is a schematic view of the exercise apparatus utilized in an exercise.

The weight horn 40 extends in a perpendicular manner from the base plate 30 along a weight horn axis W. The weight horn 40 may be a generally tubular member that is sized to receive weight plates P such that the plates are stacked upon the flat planar plate 32 (FIG. 3).

With reference to FIG. 2, the restraint assembly 50 includes a spar 52 that extends in a perpendicular manner from the base plate 30 along a restraint assembly axis L. The spar 52 may be rigidly attached to base plate 30 such as, e.g., via welding such that axis L is parallel to axis W and laterally centered on the base plate 30.

Figure 5:
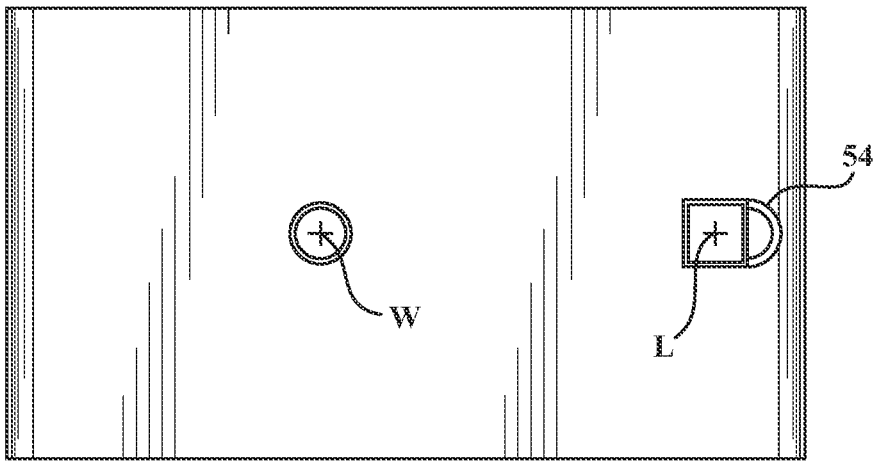
FIG. 5 is a top view of the exercise apparatus.
Figure 6:
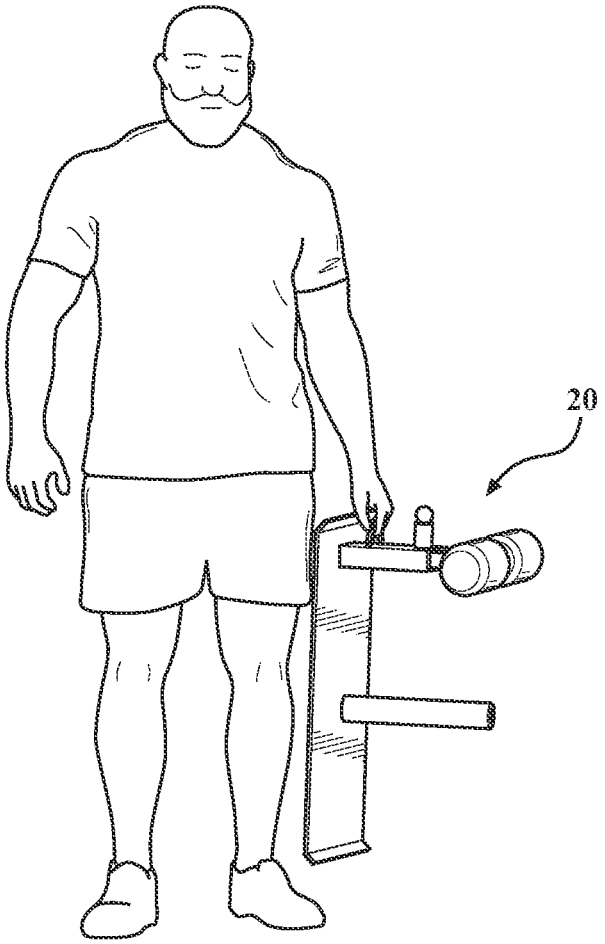
FIG. 6 is a schematic view of the exercise apparatus being transported.

An attachment point 54 (FIG. 5) may be affixed to the spar 52 along a forward surface thereof to receive a clip C attached to a strap S or rope to allow the exercise apparatus 20 to be dragged and thereby may operate as a weight sled (FIG. 4). The exercise apparatus 20 when unloaded of weight plates, is compact and readily transportable by the attachment point 54 (FIG. 6).

The spar 52 may be square in cross-section to telescopically receive an adjustable spar 60. The adjustable spar 60 supports a cross-member 62 that may be sheathed with cylindrical cushions 64 thereby providing ankle restraints.

A quick release bolt 70 in the spar 52 combined with complementary holes 72 in the adjustable spar 60 facilitate the height adjustability of the ankle restraints.

The exercise apparatus 20, when loaded with weight plates P, provides for the effective performance of Nordic hamstring curl exercises (FIG. 3), and other exercises (one example exercise shown in FIG. 4) at any location without the necessity of a spotter. The Nordic hamstring exercise is performed by kneeling with your feet held fixed by the restraint assembly 50. The person undertaking the exercise crosses their arms across their chest and lowers their body slowly towards the ground ensuring they keep a straight line from their shoulder to their knee. They extend slowly to the point of failure, i.e., they lean forward and resist a falling motion using their hamstrings for as long as possible. As they progress, they hold for 3-6 seconds then drop to the ground using their hands to break the fall. Return at ease to the start position and repeat.

The exercise apparatus 20 may be rear loaded with weight plates P with respect to the user and the restraint assembly 50. In some such exercises the user may brace their feet upon the weight plates P for the effective performance of Nordic hamstring curl exercises (FIG. 3).

The exercise apparatus 20 when unloaded of weight plates P, is compact and readily transportable.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed is:

1. An exercise apparatus, comprising:
- a base plate;
- a weight horn that extends from the base plate along a weight horn axis transverse to the base plate; and
- a restraint assembly to provide ankle restraints, the restraint assembly extends from the base plate along a restraint assembly axis transverse to the base plate.

2. The exercise apparatus as recited in claim 1, wherein the restraint assembly comprises a spar to telescopically receive an adjustable spar.

3. The exercise apparatus as recited in claim 2, further comprising a cross-member that extends from the adjustable spar.

4. The exercise apparatus as recited in claim 3, further comprising cylindrical cushions that sheath the cross-member.

5. The exercise apparatus as recited in claim 4, further comprising a quick release bolt selectively engageable with one of a multiple of complementary holes in the adjustable spar to permit height adjustability of the ankle restraints.

6. The exercise apparatus as recited in claim 2, further comprising an attachment point affixed to the spar.

7. The exercise apparatus as recited in claim 1, further comprising a cylindrical cushion that sheathes a cross-member of the restraint assembly.

8. The exercise apparatus as recited in claim 7, further comprising an adjustable spar to support the cross-member.

9. The exercise apparatus as recited in claim 8, wherein the weight horn axis is parallel to the restraint assembly axis.

10. The exercise apparatus as recited in claim 1, wherein one or more edges of the base plate form an upturned lip.

11. The exercise apparatus as recited in claim 1, wherein the weight horn axis is parallel to the restraint assembly axis.

12. An exercise apparatus, comprising:
- a base plate comprising a lateral edge that forms an upturned lip;
- a weight horn that extends from the base plate along a weight horn axis perpendicular to the base plate; and
- a restraint assembly that extends from the base plate along a restraint assembly axis perpendicular to the base plate, the weight horn axis parallel to the restraint assembly axis, wherein the restraint assembly comprises:
  - a spar;
  - an adjustable spar telescopically movable with respect to the spar;
  - a cross-member that extends from the adjustable spar; and
  - a cylindrical cushion that sheaths the cross-member to provide ankle restraints.

13. The exercise apparatus as recited in claim 12, wherein the spar and the adjustable spar are square in cross-section.

14. The exercise apparatus as recited in claim 13, wherein the weight horn is circular in cross-section.

15. The exercise apparatus as recited in claim 12, further comprising an attachment point affixed to the restraint assembly.

16. The exercise apparatus as recited in claim 12, further comprising a quick release bolt selectively engageable with one of a multiple of complementary holes in the adjustable spar to permit height adjustability of the ankle restraints.

* * * * *